US009786241B2

(12) United States Patent
Du

(10) Patent No.: US 9,786,241 B2
(45) Date of Patent: Oct. 10, 2017

(54) LIQUID CRYSTAL DISPLAY AND GATE DRIVER ON ARRAY CIRCUIT

(71) Applicant: SHENZHEN CHINA STAR OPTOELECTRONICS TECHNOLOGY CO., LTD., Shenzhen, Guangdong (CN)

(72) Inventor: Peng Du, Guangdong (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 122 days.

(21) Appl. No.: 14/905,876

(22) PCT Filed: Dec. 23, 2015

(86) PCT No.: PCT/CN2015/098427

§ 371 (c)(1),
(2) Date: Jan. 18, 2016

(87) PCT Pub. No.: WO2017/084146

PCT Pub. Date: May 26, 2017

(65) Prior Publication Data

US 2017/0229083 A1 Aug. 10, 2017

(30) Foreign Application Priority Data

Nov. 16, 2015 (CN) ..... 2015 1 0782727

(51) Int. Cl.
*G09G 3/36* (2006.01)

(52) U.S. Cl.
CPC ..... *G09G 3/3677* (2013.01); *G09G 3/3696* (2013.01); *G09G 2300/0809* (2013.01)

(58) Field of Classification Search
CPC ..... G09G 3/3677; G09G 3/3696; G09G 2300/0809
See application file for complete search history.

(56) References Cited

U.S. PATENT DOCUMENTS 8,203,513 B2 * 6/2012 Chung ..... G02F 1/136213 345/208
8,866,799 B2 * 10/2014 Jun ..... G09G 3/36 345/204

(Continued)

FOREIGN PATENT DOCUMENTS

CN 101216645 A 7/2008
CN 102109696 A 6/2011

(Continued)

*Primary Examiner* — Ryan A Lubit
(74) *Attorney, Agent, or Firm* — Ladas & Parry LLP

(57) ABSTRACT

A GOA circuit for an LCD includes GOA units connected in cascade and the plurality of GOA units at stages formed. The GOA unit at an nth stage corresponds to a scan line. The scan line includes a nth scan line, a (n+1)th scan line, and a (n+2)th scan line. The GOA unit at the an nth stage includes a first pull-down holding circuit, a pull-up circuit, a bootstrap capacitance circuit, a pull-down circuit, and a clock circuit. The improved GOA circuit at one stage corresponds to the output of three gate lines. So a number of the stages of the GOA circuit is reduced. Only ⅓ stage of the conventional GOA circuit is needed. Because of the decrease in the number of the stages, more flexibility of design is given to the GOA circuit at each stage. It is beneficiary for the design in narrow bezels.

17 Claims, 8 Drawing Sheets

(56) References Cited

U.S. PATENT DOCUMENTS

| | | | | |
|---|---|---|---|---|
| 8,890,790 | B2 * | 11/2014 | Lin | G09G 3/3688 345/100 |
| 2005/0036091 | A1 | 2/2005 | Song | |
| 2014/0159997 | A1 | 6/2014 | Chen et al. | |
| 2015/0294636 | A1 * | 10/2015 | Yu | G09G 3/3655 345/204 |
| 2016/0005372 | A1 * | 1/2016 | Yu | G09G 3/3677 345/208 |

FOREIGN PATENT DOCUMENTS

| | | | |
|---|---|---|---|
| CN | 102983132 | A | 3/2013 |
| CN | 103578433 | A | 2/2014 |
| KR | 20110090331 | A | 8/2011 |

* cited by examiner

LIQUID CRYSTAL DISPLAY AND GATE DRIVER ON ARRAY CIRCUIT

BACKGROUND OF THE INVENTION

1. Field of the Invention

The present invention relates to the field of liquid crystal displays (LCDs), and more particularly, to a gate driver on array (GOA) circuit applying to LCDs.

2. Description of the Prior Art

The design of narrow bezels becomes very popular on the market. On the contrary, the border of the panel is gradually reduced. The height h of wiring layout of the GOA circuit at each stage is consistent with the size of a corresponding pixel for the conventional GOA circuit. Since products using display panels with 4 k or more pixel per inch (PPI) resolution become popular, the size of the pixel gets smaller. In other words, the room for wiring layout of the GOA circuit is decreased as well. The restriction of the height is compensated for the larger width, which is very disadvantageous to the design of the narrow bezel.

The tri-gate structure is a common method of reducing cost. With respect to tri-gate structure, the number of scan lines is triple the number of the original design while the number of data lines is one third of the original design. The use of the data lines greatly reduces. In general, a source chip, i.e. source integrated circuit (IC) is more expensive than a gate chip, i.e. gate IC, so the goal to cost saving is achieved. The use of tri-gate structure with the GOA circuit makes it possible that no gate ICs and quite a few source ICs are used in the panel. Therefore, the cost of the panel is reduced, which is quite competitive on the market.

However, the space for the GOA circuit at each stage gets smaller since the number of scan lines is triple the number of the original design after the structure of tri-gate is adopted. Based on the structure of the conventional circuit, the width of the GOA area is sacrificed, but it is not disadvantageous to the popular bezel design nowadays.

Tri-gate is often used in a low-cost panel. Take a full high definition (FHD) panel for example. A standard panel comprises 1080 gate lines and 5760 data lines. Totally, 6840 signal lines are used. A panel with tri-gate comprises 3240 common gate lines and 1920 data lines. Totally, 5160 signal lines are used. It is obvious that the panel with tri-gate has fewer signals lines than the standard panel does. No gate lines are needed for the structure tri-gate integrated with GOA. Therefore, the cost of panels is reduced to the largest scale.

The gate signal node Q(n) is a critical electric potential for the GOA circuit. When the gate signal node Q(n) is at high voltage level, the GOA circuit keeps opening and outputting. On the contrary, the GOA circuit keeps closed when the gate signal node Q(n) is at low voltage level. In the meantime, the gate signal output by the GOA circuit is also at low voltage level.

Please refer to FIG. 1. FIG. 1 is a circuit diagram of a conventional GOA circuit 10. The GOA circuit 10 comprises a plurality of GOA units 15. The plurality of GOA units 15 are connected in cascade. The GOA unit 15 at the nth stage charges a corresponding scan line G(n). The GOA unit 15 comprises a clock circuit 100, a pull-down circuit 200, a bootstrap capacitance circuit 300, a pull-up circuit 400, and a pull-down circuit 500. The basic structure of GOA unit 15 comprises the clock circuit 100, the pull-down circuit 200, the bootstrap capacitance circuit 300, and the pull-up circuit 400. The GOA unit 15 comprises four thin-film transistors (TFTs) and a capacitor. Because amorphous silicon may be unstable and unreliable, the pull-down circuit 500 is also needed except for the basic structure. The main function of the pull-down circuit 500 is to pull-down voltage of the gate line G(n), that is, to ensure that the output of the GOA circuit and the gate signal node Q(n) keep at low voltage level and that the stability of the GOA circuit in operation is enhanced.

Two auxiliary pull-down circuits are usually used in the conventional design. The function of the auxiliary pull-down circuits is pulling voltage of the gate signal node Q(n) down when the GOA circuit is closed so that the gate signal node Q(n) can keeps low voltage level. It ensures the normal working state of the panel and the increasing stability of the panel. The auxiliary pull-down circuit usually comprises more TFTs. These TFTs occupies larger space, which is disadvantageous when the narrow bezel is taken into consideration. With respect to the two auxiliary pull-down circuits, a detailed introduction is provided as follows. Please refer to FIG. 2 as well.

Please refer to FIG. 2 and FIG. 3. FIG. 2 is a circuit diagram of another conventional GOA circuit 20. FIG. 3 shows waveforms of signals applied the GOA circuit 20 as shown in FIG. 2. Compared with FIG. 1, the pull-down circuit 500 comprises a first auxiliary pull-down circuit 510 and a second auxiliary pull-down circuit 520. The first auxiliary pull-down circuit 510 and the second auxiliary pull-down circuit 520 are controlled by a low-frequency signal LC1 and a low-frequency signal LC2, respectively. The first auxiliary pull-down circuit 510 and the second auxiliary pull-down circuit 520 operate alternatively at different periods of time to ensure that the output terminal of the GOA circuit and the gate signal node Q(n) keep at low voltage level when the gate line G(n) is closed. The low-frequency signal LC1 and the low-frequency signal LC2 are inversed. When the low-frequency signal LC1 is at high voltage level, the first auxiliary pull-down circuit 510 is used to pull down the voltage of the gate line G(n) while the second auxiliary pull-down circuit 520 is at low voltage level at this time. After a plurality of frames, the low-frequency signal LC1 becomes at low voltage level and the low-frequency signal LC2 becomes at high voltage level. The second auxiliary pull-down circuit 520 is used to pull down the voltage of the gate line G(n). Further, the pull-down circuit 500 can have other structures. FIG. 3 shows that the CK signal at six stages working with the low-frequency signal LC1 and the low-frequency signal LC2 switch once about every 100 frames for producing corresponding signals of the gate line G(n). The feature of the circuit shown in FIG. 2 is that the GOA circuit at every stage corresponds to the output of a gate line G(n). Once the panel adopts tri-gate structure, the number of scan lines is triple the number of the original design while the height of space occupied by the GOA circuit at each stage becomes one third of the original design. The width of the wiring layout has to be enlarged. As a result, the border of the panel needs to be broadened, which is disadvantageous to the popular narrow bezel design.

Therefore, it is necessary to propose a GOA circuit applying to LCDs to resolve the problem happening in the conventional technology.

SUMMARY OF THE INVENTION

An object of the present invention is to propose a GOA circuit applying to LCDs.

According to the present invention, a gate driver on array (GOA) circuit for a liquid crystal display (LCD) comprises a plurality of GOA units connected in cascade and the plurality of GOA units at stages formed. The GOA unit at an nth stage corresponds to at least one scan line. The at least one scan line comprises a nth scan line, a (n+1)th scan line, and a (n+2)th scan line. The GOA unit at the an nth stage comprises a first pull-down holding circuit, a pull-up circuit, a bootstrap capacitance circuit, a pull-down circuit, and a clock circuit.

The first pull-down holding circuit is connected to a gate signal node. The pull-up circuit is connected to the first pull-down holding circuit through the gate signal node. The bootstrap capacitance circuit is connected to the pull-up circuit through the gate signal node. The pull-down circuit is connected to the bootstrap capacitance circuit through the gate signal node. The clock circuit is connected to the bootstrap capacitance circuit through the gate signal node and receiving a first clock signal.

The first pull-down holding circuit and the pull-down circuit are connected to a direct current low supply voltage.

The clock circuit comprises a first transistor, a second transistor, a third transistor, and a fourth transistor.

The first transistor comprises a first control terminal connected to the gate signal node, a first input terminal connected to the first clock signal, and a first output terminal outputting a start pulse at an nth stage. The second transistor comprises a second control terminal connected to the gate signal node, a second input terminal connected to the first clock signal, and a second output terminal connected to the nth scan line. The third transistor comprises a third control terminal connected to the gate signal node, a third input terminal connected to the first clock signal, and a third output terminal connected to the (n+1)th scan line. The fourth transistor comprises a fourth control terminal connected to the gate signal node, a fourth input terminal connected to the first clock signal, and a fourth output terminal connected to the (n+2)th scan line.

According to one preferred embodiment, the bootstrap capacitance circuit comprises a first capacitor which comprises two terminals connected to the gate signal node and the start pulse at the nth stage, respectively.

According to one preferred embodiment, the pull-up circuit comprises a fifth transistor. The fifth transistor comprises a fifth control terminal receiving a start pulse at an (n−3)th stage, a fifth input terminal connected to the fifth control terminal, and a fifth output terminal connected to the gate signal node.

According to one preferred embodiment, the first pull-down holding circuit comprises a sixth transistor, a seventh transistor, an eighth transistor, a ninth transistor, a tenth transistor, an eleventh transistor, and a twelfth transistor.

The sixth transistor comprises a sixth control terminal receiving a start pulse at the (n+3)th stage, a sixth input terminal connected to the direct current low supply voltage, and a sixth output terminal connected to the gate signal node. The seventh transistor comprises a seventh control terminal connected to the gate signal node, and a seventh input terminal connected to the direct current low supply voltage. The eighth transistor comprises an eighth control terminal connected to a direct current high supply voltage, an eighth output terminal connected to the eighth control terminal, and an eighth input terminal connected to a seventh output terminal. The ninth transistor comprises a ninth control terminal connected to the gate signal node, and a ninth input terminal connected to the direct current low supply voltage. The tenth transistor comprises a tenth control terminal connected to the seventh output terminal, a tenth input terminal connected to the ninth output terminal, and a tenth output terminal connected to the eighth output terminal. The eleventh transistor comprises an eleventh control terminal connected to the tenth input terminal, an eleventh input terminal connected to the direct current low supply voltage, and an eleventh output terminal connected to the gate signal node. The twelfth transistor comprises a twelfth control terminal connected to the tenth input terminal, a twelfth input terminal connected to the direct current low supply voltage, and a twelfth output terminal connected to the start pulse at the nth stage.

According to one preferred embodiment, the pull-down circuit comprises a thirteenth transistor, a fourteenth transistor, a fifteenth transistor, a sixteenth transistor, a seventeenth transistor, an eighteenth transistor, a nineteenth transistor, a twentieth transistor, and a twentieth-first transistor.

The thirteenth transistor comprises a thirteenth control terminal connected to the first pull-down holding circuit, a thirteenth input terminal connected to the direct current low supply voltage, and a thirteenth output terminal connected to the nth scan line. The fourteenth transistor comprises a fourteenth control terminal connected to a second clock, a fourteenth input terminal connected to the direct current low supply voltage, and a fourteenth output terminal connected to the nth scan line. The fifteenth transistor comprises a fifteenth control terminal connected to a fourth clock signal, a fifteenth input terminal connected to the direct current low supply voltage, and a fifteenth output terminal connected to the nth scan line. The sixteenth transistor comprises a sixteenth control terminal connected to the first pull-down holding circuit, a sixteenth input terminal connected to the direct current low supply voltage, and a sixteenth output terminal connected to the (n+1)th scan line. The seventeenth transistor comprises a seventeenth control terminal connected to a third clock signal, a seventeenth input terminal connected to the direct current low supply voltage, and a seventeenth output terminal connected to the (n+1)th scan line. The eighteenth transistor comprises an eighteenth control terminal connected to a fifth clock signal, an eighteenth input terminal connected to the direct current low supply voltage, and an eighteenth output terminal connected to the (n+1)th scan line. The nineteenth transistor comprises a nineteenth control terminal connected to the first pull-down holding circuit, a nineteenth input terminal connected to the direct current low supply voltage, and a nineteenth output terminal connected to the (n+2)th scan line. The twentieth transistor comprises a twentieth control terminal connected to the fourth clock signal, a twentieth input terminal connected to the direct current low supply voltage, and a twentieth output terminal connected to the (n+2)th scan line. The twentieth-first transistor comprises a twenty-first control terminal connected to a sixth clock signal, a twenty-first input terminal connected to the direct current low supply voltage, and a twenty-first output terminal connected to the (n+2)th scan line.

According to one preferred embodiment, the GOA circuit further comprises a second pull-down holding circuit. The second pull-down holding circuit comprises a twentieth-second transistor and a twentieth-third transistor. The twentieth-second transistor comprises a twenty-second control terminal connected to the fourth clock signal, a twenty-second input terminal connected to a direct current low supply voltage, and a twenty-second output terminal connected to the gate signal node. The twentieth-third transistor comprises a twenty-third control terminal connected to the fourth clock signal, a twenty-third input terminal connected to the direct current low supply voltage, and a twenty-third output terminal connected to the start pulse at the nth stage.

According to one preferred embodiment, the cycle of the first clock signal, the cycle of the second clock signal, and the cycle of the third clock signal are the same, and the first clock signal, the second clock signal, and the third clock signal are triggered subsequently based on the difference of a ⅓ cycle.

According to one preferred embodiment, the fourth clock signal is inversed to the first clock signal, the fifth clock signal is inversed to the second clock signal, and the sixth clock signal is inversed to the third clock signal.

According to the present invention, a gate driver on array (GOA) circuit for a liquid crystal display (LCD) comprises: a plurality of GOA units connected in cascade and the plurality of GOA units at stages formed. The GOA unit at an nth stage corresponds to at least one scan line. The at least one scan line comprise (n+3)th scan line, a (n+4)th scan line, and a (n+5)th scan line. The GOA unit at the an nth stage comprises a first pull-down holding circuit, a pull-up circuit, a bootstrap capacitance circuit, a pull-down circuit, and a clock circuit.

The first pull-down holding circuit is connected to a gate signal node. The pull-up circuit is connected to the first pull-down holding circuit through the gate signal node. The bootstrap capacitance circuit is connected to the pull-up circuit through the gate signal node. The pull-down circuit is connected to the bootstrap capacitance circuit through the gate signal node. The clock circuit is connected to the bootstrap capacitance circuit through the gate signal node and receiving a first clock signal.

The first pull-down holding circuit and the pull-down circuit are connected to a direct current low supply voltage.

The clock circuit comprises a first transistor, a second transistor, a third transistor, and a fourth transistor.

The first transistor comprises a first control terminal connected to the gate signal node, a first input terminal connected to the fourth clock signal, and a first output terminal outputting a start pulse at an (n+3)th stage. The second transistor comprises a second control terminal connected to the gate signal node, a second input terminal connected to the fourth clock signal, and a second output terminal connected to the (n+4)th scan line. The third transistor comprises a third control terminal connected to the gate signal node, a third input terminal connected to the fourth clock signal, and a third output terminal connected to the (n+5)th scan line. The fourth transistor comprises a fourth control terminal connected to the gate signal node, a fourth input terminal connected to the fourth clock signal, and a fourth output terminal connected to the (n+5)th scan line.

According to one preferred embodiment, the bootstrap capacitance circuit comprises a first capacitor. The first capacitor comprises two terminals connected to the gate signal node and the start pulse at the (n+3)th stage, respectively.

According to one preferred embodiment, the pull-up circuit comprises a fifth transistor. The fifth transistor comprises a fifth control terminal receiving a start pulse at an nth stage, a fifth input terminal connected to the fifth control terminal, and a fifth output terminal connected to the gate signal node.

According to one preferred embodiment, the first pull-down holding circuit comprises a sixth transistor, a seventh transistor, an eighth transistor, a ninth transistor, a tenth transistor, an eleventh transistor, and a twelfth transistor.

The sixth transistor comprises a sixth control terminal receiving a start pulse at the (n+6)th stage, a sixth input terminal connected to the direct current low supply voltage, and a sixth output terminal connected to the gate signal node. The seventh transistor comprises a seventh control terminal connected to the gate signal node, and a seventh input terminal connected to the direct current low supply voltage. The eighth transistor comprises an eighth control terminal connected to a direct current high supply voltage, an eighth output terminal connected to the eighth control terminal, and an eighth input terminal connected to a seventh output terminal. The ninth transistor comprises a ninth control terminal connected to the gate signal node, and a ninth input terminal connected to the direct current low supply voltage. The tenth transistor comprises a tenth control terminal connected to the seventh output terminal, a tenth input terminal connected to the ninth output terminal, and a tenth output terminal connected to the eighth output terminal. The eleventh transistor comprises an eleventh control terminal connected to the tenth input terminal, an eleventh input terminal connected to the direct current low supply voltage, and an eleventh output terminal connected to the gate signal node. The twelfth transistor comprises a twelfth control terminal connected to the tenth input terminal, a twelfth input terminal connected to the direct current low supply voltage, and a twelfth output terminal connected to the start pulse at the (n+3)th stage.

According to one preferred embodiment, the pull-down circuit comprises a thirteenth transistor, a fourteenth transistor, a fifteenth transistor, a sixteenth transistor, a seventeenth transistor, an eighteenth transistor, a nineteenth transistor, a twentieth transistor, and a twentieth-first transistor.

The thirteenth transistor comprises a thirteenth control terminal connected to the first pull-down holding circuit, a thirteenth input terminal connected to the direct current low supply voltage, and a thirteenth output terminal connected to the (n+3)th scan line. The fourteenth transistor comprises a fourteenth control terminal connected to a first clock, a fourteenth input terminal connected to the direct current low supply voltage, and a fourteenth output terminal connected to the (n+3)th scan line. The fifteenth transistor comprises a fifteenth control terminal connected to a third clock signal, a fifteenth input terminal connected to the direct current low supply voltage, and a fifteenth output terminal connected to the (n+3)th scan line. The sixteenth transistor comprises a sixteenth control terminal connected to the first pull-down holding circuit, a sixteenth input terminal connected to the direct current low supply voltage, and a sixteenth output terminal connected to the (n+4)th scan line. The seventeenth transistor comprises a seventeenth control terminal connected to a second clock signal, a seventeenth input terminal connected to the direct current low supply voltage, and a seventeenth output terminal connected to the (n+4)th scan line. The eighteenth transistor comprises an eighteenth control terminal connected to a fourth clock signal, an eighteenth input terminal connected to the direct current low supply voltage, and an eighteenth output terminal connected to the (n+4)th scan line. The nineteenth transistor comprises a nineteenth control terminal connected to the first pull-down holding circuit, a nineteenth input terminal connected to the direct current low supply voltage, and a nineteenth output terminal connected to the (n+5)th scan line. The twentieth transistor comprises a twentieth control terminal connected to the third clock signal, a twentieth input terminal connected to the direct current low supply voltage, and a twentieth output terminal connected to the (n+5)th scan line. The twentieth-first transistor comprises a twenty-first control terminal connected to a fifth clock signal, a twenty-first input terminal connected to the direct current low supply voltage, and a twenty-first output terminal connected to the (n+5)th scan line.

According to one preferred embodiment, the GOA circuit further comprises a second pull-down holding circuit. The second pull-down holding circuit comprises a twentieth-second transistor and a twentieth-third transistor. The twentieth-second transistor comprises a twenty-second control terminal connected to the first clock signal, a twenty-second input terminal connected to a direct current low supply voltage, and a twenty-second output terminal connected to the gate signal node. The twentieth-third transistor comprises a twenty-third control terminal connected to the first clock signal, a twenty-third input terminal connected to the direct current low supply voltage, and a twenty-third output terminal connected to the start pulse at the (n+3)th stage.

According to one preferred embodiment, the cycle of the first clock signal, the cycle of the second clock signal, and the cycle of the third clock signal are the same, and the first clock signal, the second clock signal, and the third clock signal are triggered subsequently based on the difference of a ⅓ cycle.

According to one preferred embodiment, the fourth clock signal is inversed to the first clock signal, the fifth clock signal is inversed to the second clock signal, and the sixth clock signal is inversed to the third clock signal.

With respect to the GOA circuit comprising three gates, the present invention proposes an improved GOA circuit. The improved GOA circuit at one stage corresponds to the output of three gate lines while the conventional GOA circuit at one stage corresponds to the output of one gate line. So a number of the stages of the GOA circuit is reduced. Only ⅓ stage of the conventional GOA circuit is needed. Because of the decrease in the number of the GOA circuit, more flexibility of design is given to the GOA circuit at each stage. It is beneficiary for the design in narrow bezels.

DETAILED DESCRIPTION OF THE PREFERRED EMBODIMENTS

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

Figure 4:
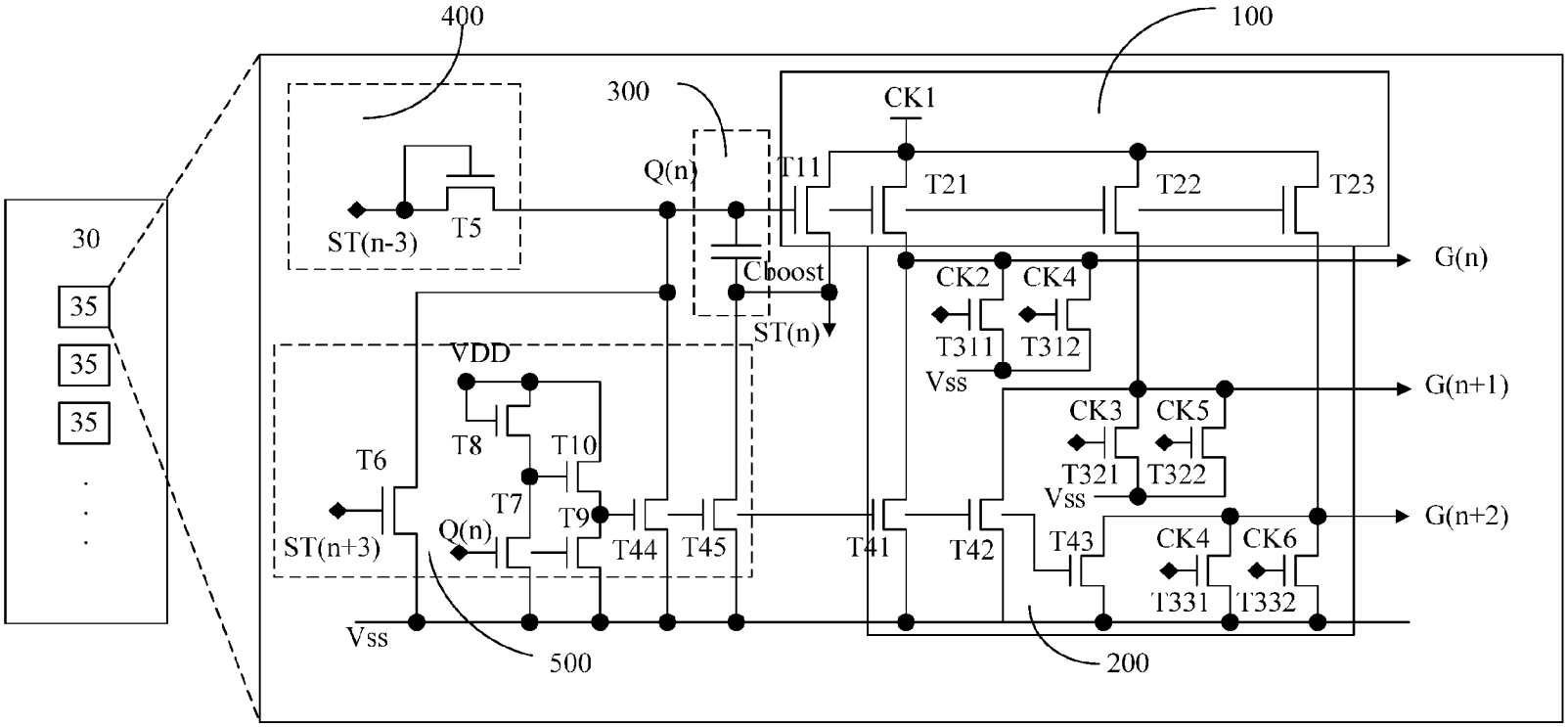
FIG. 4 is a circuit diagram of a GOA circuit according to a first preferred embodiment of the present invention.

FIG. 4 is a circuit diagram of the structure of a GOA circuit 30 according to a first preferred embodiment of the present invention. The GOA circuit 30 is used for liquid crystal displays (LCDs). The GOA circuit 30 comprises a plurality of GOA units 35. The plurality of GOA units 35 connected in cascade to form GOA units 35 at a plurality of stages. The GOA unit 35 at the nth stage corresponds to at least one scan line at one stage. The at least one scan line comprises a scan line G(n) at the nth stage, a scan line G(n+1) at the (n+1)th stage, and a scan line G(n+2) at the (n+2)th stage. The GOA unit 35 at the nth stage comprises a first pull-down holding circuit 500, a pull-up circuit 400, a bootstrap capacitance circuit 300, a pull-down circuit 200, and a clock circuit 100.

The first pull-down holding circuit 500 is connected to a gate signal node Q(n). The pull-up circuit 400 is connected to the first pull-down holding circuit 500 through the gate signal node Q(n). The bootstrap capacitance circuit 300 is connected to the pull-up circuit 400 through the gate signal node Q(n). The pull-down circuit 200 is connected to the bootstrap capacitance circuit 300 through the gate signal node Q(n). The clock circuit 100 is connected to the bootstrap capacitance circuit 300 through the gate signal node Q(n) and receives a first clock signal CK1.

The first pull-down holding circuit 500 and the pull-down circuit 200 are connected to a direct current low supply voltage.

The clock circuit 100 comprises a first transistor T11, a second transistor T21, a third transistor T22, and a fourth transistor T23.

The first transistor T11 comprises a first control terminal, a first input terminal, and a first output terminal. The first control terminal is connected to the gate signal node Q(n). The first input terminal is connected to the first clock signal CK1. The first output terminal outputs a start pulse ST(n) at the nth stage. The second transistor T21 comprises a second control terminal, a second input terminal, and a second output terminal. The second control terminal is connected to the gate signal node Q(n). The second input terminal is connected to the first clock signal CK1. The second output terminal is connected to the scan line G(n) at the nth stage. The third transistor T22 comprises a third control terminal, a third input terminal, and a third output terminal. The third control terminal is connected to the gate signal node Q(n). The third input terminal is connected to the first clock signal CK1. The third output terminal is connected to the scan line G(n+1) at the (n+1)th stage. The fourth transistor T23 comprises a fourth control terminal, a fourth input terminal, and a fourth output terminal. The fourth control terminal is connected to the gate signal node Q(n). The fourth input terminal is connected to the first clock signal CK1. The fourth output terminal is connected to the scan line G(n+2) at the (n+2)th stage.

The bootstrap capacitance circuit 300 comprises a first capacitor $C_{boost}$. The first capacitor $C_{boost}$ comprises two terminals. The terminals are connected to a gate signal node Q(n) and a start pulse at the nth stage ST(n), respectively.

The pull-up circuit 400 comprises a fifth transistor T5. The fifth transistor T5 comprises a fifth control terminal, a fifth input terminal, and a fifth output terminal. The fifth control terminal receives a start pulse ST(n−3) at the (n−3)th stage. The fifth input terminal is connected to the fifth control terminal. The fifth output terminal is connected to the gate signal node Q(n).

The first pull-down holding circuit 500 comprises a sixth transistor T6, a seventh transistor T7, an eighth transistor T8, a ninth transistor T9, a tenth transistor T10, an eleventh transistor T44, and a twelfth transistor T41.

The sixth transistor T6 comprises a sixth control terminal, a sixth input terminal, and a sixth output terminal. The sixth control terminal receives a start pulse ST(n+3) at the (n+3)th stage. The sixth input terminal is connected to the direct current low supply voltage Vss. The sixth output terminal is connected to the gate signal node Q(n). The seventh transistor T7 comprises a seventh control terminal, a seventh input terminal, and a seventh output terminal. The seventh control terminal is connected to the gate signal node Q(n). The seventh input terminal is connected to the direct current low supply voltage Vss. The eighth transistor T8 comprises an eighth control terminal, an eighth input terminal, and an eighth output terminal. The eighth control terminal is connected to a direct current high supply voltage VDD. The eighth output terminal is connected to the eighth control terminal. The eighth input terminal is connected to the seventh output terminal. The ninth transistor T9 comprises a ninth control terminal, a ninth input terminal, and a ninth output terminal. The ninth control terminal is connected to the gate signal node Q(n). The ninth input terminal is connected to the direct current low supply voltage Vss. The tenth transistor T10 comprises a tenth control terminal, a tenth input terminal, and a tenth output terminal. The tenth control terminal is connected to the seventh output terminal. The tenth input terminal is connected to the ninth output terminal. The tenth output terminal is connected to the eighth output terminal. The eleventh transistor T44 comprises an eleventh control terminal, an eleventh input terminal, and an eleventh output terminal. The eleventh control terminal is connected to the tenth input terminal. The eleventh input terminal is connected to the direct current low supply voltage Vss. The eleventh output terminal is connected to the gate signal node Q(n). The twelfth transistor T45 comprises a twelfth control terminal, a twelfth input terminal, and a twelfth output terminal. The twelfth control terminal is connected to the tenth input terminal. The twelfth input terminal is connected to the direct current low supply voltage Vss. The twelfth output terminal outputs the start pulse ST(n) at the nth stage.

The pull-down circuit 200 comprises a thirteenth transistor T41, a fourteenth transistor T311, a fifteenth transistor T312, a sixteenth transistor T42, a seventeenth transistor T321, an eighteenth transistor T322, a nineteenth transistor T43, a twentieth transistor T331, and a twenty-first transistor T332.

The thirteenth transistor T41 comprises a thirteenth control terminal, a thirteenth input terminal, and a thirteenth output terminal. The thirteenth control terminal is connected to the first pull-down holding circuit 500. The thirteenth input terminal is connected to the direct current low supply voltage Vss. The thirteenth output terminal is connected to the nth scan line G(n). The fourteenth transistor T311 comprises a fourteenth control terminal, a fourteenth input terminal, and a fourteenth output terminal. The fourteenth control terminal is connected to the second clock CK2. The fourteenth input terminal is connected to the direct current low supply voltage Vss. The fourteenth output terminal is connected to the nth scan line G(n). The fifteenth transistor T312 comprises a fifteenth control terminal, a fifteenth input terminal, and a fifteenth output terminal. The fifteenth control terminal is connected to the fourth clock signal CK4. The fifteenth input terminal is connected to the direct current low supply voltage Vss. The fifteenth output terminal is connected to the nth scan line G(n). The sixteenth transistor T42 comprises a sixteenth control terminal, a sixteenth input terminal, and a sixteenth output terminal. The sixteenth control terminal is connected to the first pull-down holding circuit 500. The sixteenth input terminal is connected to the direct current low supply voltage Vss. The sixteenth output terminal is connected to the scan line G(n+1). The seventeenth transistor T321 comprises a seventeenth control terminal, a seventeenth input terminal, and a seventeenth output terminal. The seventeenth control terminal is connected to the third clock signal CK3. The seventeenth input terminal is connected to the direct current low supply voltage Vss. The seventeenth output terminal is connected to the scan line G(n+1). The eighteenth transistor T322 comprises an eighteenth control terminal, an eighteenth input terminal, and an eighteenth output terminal. The eighteenth control terminal is connected to the fifth clock signal CK5. The eighteenth input terminal is connected to the direct current low supply voltage Vss. The eighteenth output terminal is connected to the scan line G(n+1). The nineteenth transistor T43 comprises a nineteenth control terminal, a nineteenth input terminal, and a nineteenth output terminal. The nineteenth control terminal is connected to the first pull-down holding circuit 500. The nineteenth input terminal is connected to the direct current low supply voltage Vss. The nineteenth output terminal is connected to the scan line G(n+2). The twentieth transistor T331 comprises a twentieth control terminal, a twentieth input terminal, and a twentieth output terminal. The twentieth control terminal is connected to the fourth clock signal CK4. The twentieth input terminal is connected to the direct current low supply voltage Vss. The twentieth output terminal is connected to the scan line G(n+2). The twenty-first transistor T332 comprises a twenty-first control terminal, a twenty-first input terminal, and a twenty-first output terminal. The twenty-first control terminal is connected to the sixth clock signal CK6. The twenty-first input terminal is connected to the direct current low supply voltage Vss. The twenty-first output terminal is connected to the scan line G(n+2).

The input terminal of the first transistor T11, the input terminal of the second transistor T21, the input terminal of the third transistor T22, and the input terminal of the fourth transistor T23 are all connected to the first clock signal CK1. The control terminal (the gate) of the first transistor T11, the control terminal (the gate) of the second transistor T21, the control terminal (the gate) of the third transistor T22, and the control terminal (the gate) of the fourth transistor T23 are all connected to the gate signal node Q(n). The first transistor T11 is used for outputting the start pulse ST(n) at the nth stage for the GOA circuit at the next stage. The second transistor T21, the third transistor T22, and the fourth transistor T23 correspond to the output of three gate lines G(n), G(n+1), and G(n+2) at the home stage. As for the nth scan line G(n), the control terminal (the gate) of the fourteenth transistor T311 and the control terminal (the gate) of the fifteenth transistor T312 are controlled by the second clock CK2 and the fourth clock CK4, respectively. The fourteenth transistor T311 and the fifteenth transistor T312 are used for pulling down the signal at the scanning signal at the nth stage G(n) at different periods of time. After the second transistor T21, the third transistor T22, and the fourth transistor T23 are connected to the first clock signal CK1, their outputs are the same. Gate pulse signals from the three gate lines G(n), G(n+1), and G(n+2) do not overlap. So the signals output by the second transistor T21, the third transistor T22, and the fourth transistor T23 need to be pulled down in an appropriate period of time. The pull-down of the nth scan line G(n) has been detailed above. The pull-down of the scan line G(n+1) is completed with the seventeenth transistor T321 and the eighteenth transistor T322. The seventeenth transistor T321 and the eighteenth transistor T322 are controlled by the third clock signal CK3 and the fifth clock signal CK5. The pull-down of the scan line G(n+2) is completed with the twentieth transistor T331 and the twentieth-first transistor T332. The twentieth transistor T331 and the twentieth-first transistor T332 are controlled by the fourth clock signal CK4 and the sixth clock signal CK6. The twentieth transistor T331 and the twentieth-first transistor T332 work with the second transistor T21, the third transistor T22, and the fourth transistor T23. It ensures that the three gate lines which the GOA circuit at the stage 35 corresponds to output the correct waveforms. The thirteenth transistor T41, the sixteenth transistor T42, and the nineteenth transistor T43 are used for pulling down the three gate lines. The function of these transistors is to pull down the signals output through the nth scan line G(n), the scan line G(n+1), and the scan line G(n+2) to ensure that the output at low voltage level when the GOA circuit at the stage 35 does not work, that is, the gate signal node Q(n) at low voltage level. When the GOA circuit at the stage 35 outputs, that is, the gate signal node Q(n) at high voltage level, the control terminals (the gate) of the thirteenth transistor T41, the sixteenth transistor T42, and the nineteenth transistor T43 are at low voltage level. The control terminals are closed. There is no influence on the output of the nth scan line G(n), the scan line G(n+1), and the scan line G(n+2). The eleventh transistor T44 and the thirteenth transistor T41 are also used for pulling down signals. When the GOA circuit at the stage 35 does not output, the start pulse ST and the gate signal node Q(n) keep at low voltage level.

Figure 1:
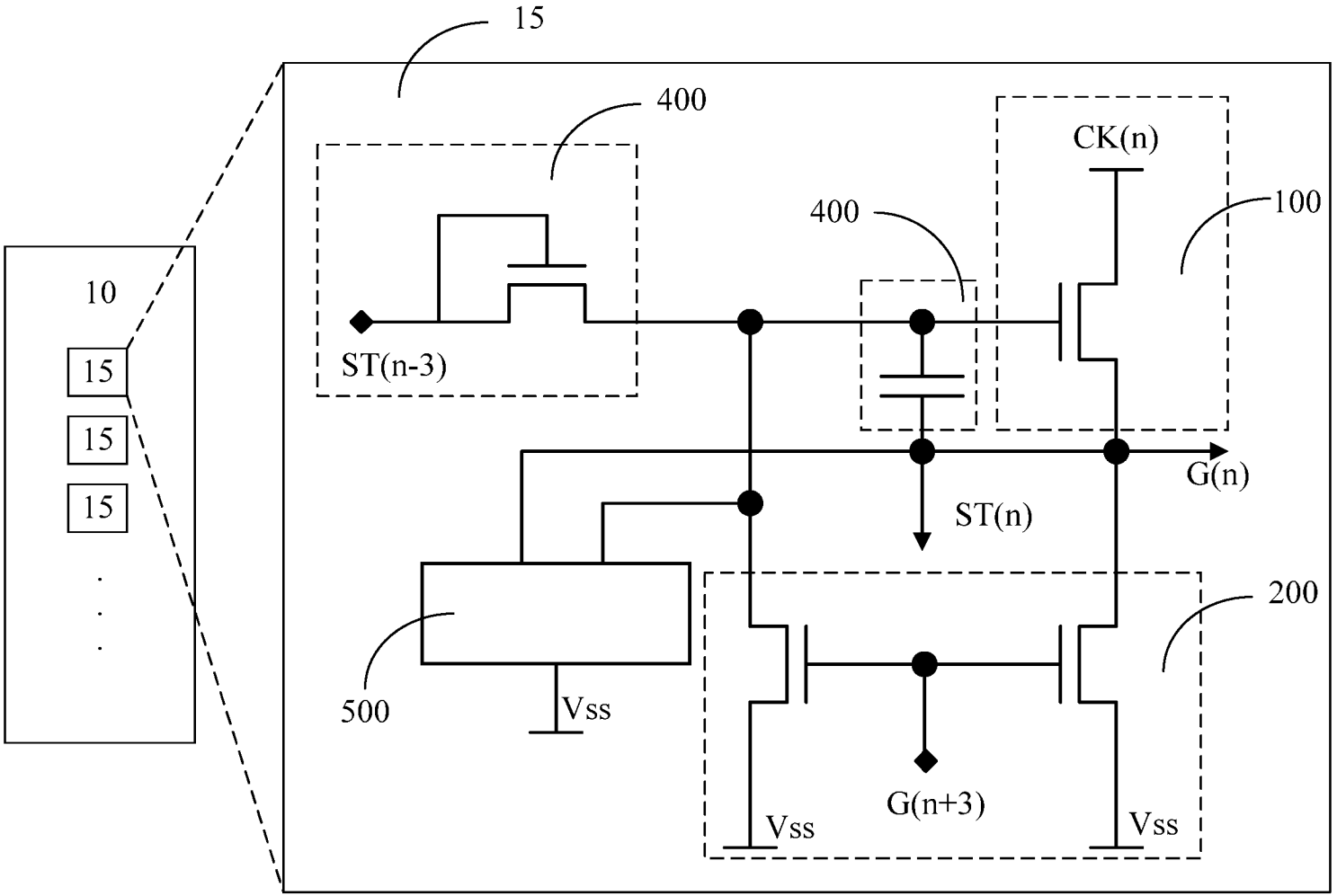
Fig. 1 (Prior art)
FIG. 1 is a circuit diagram of a conventional GOA circuit.
Figure 2:
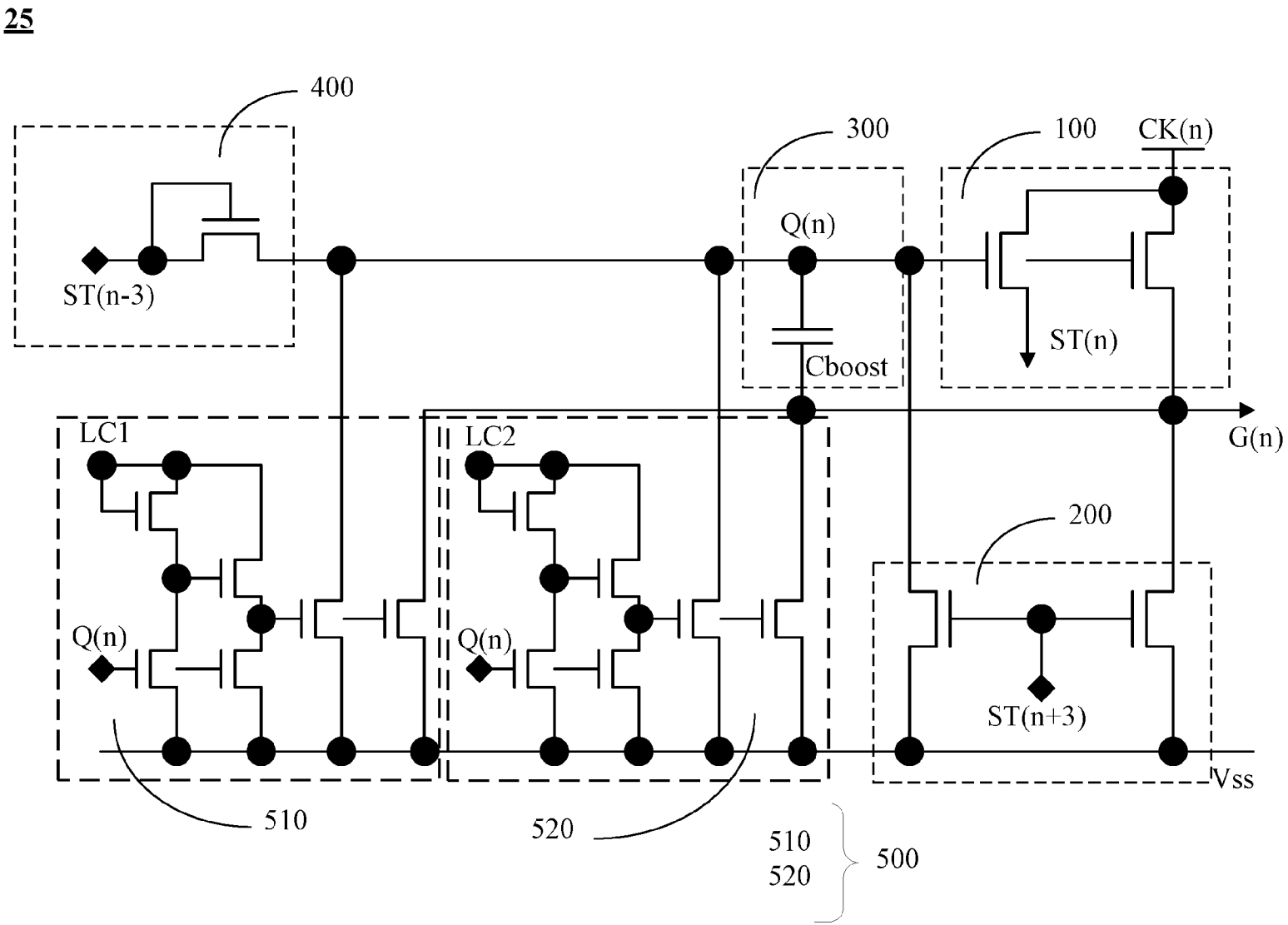
Fig. 2 (Prior art)
FIG. 2 is a circuit diagram of another conventional GOA circuit.
Figure 3:
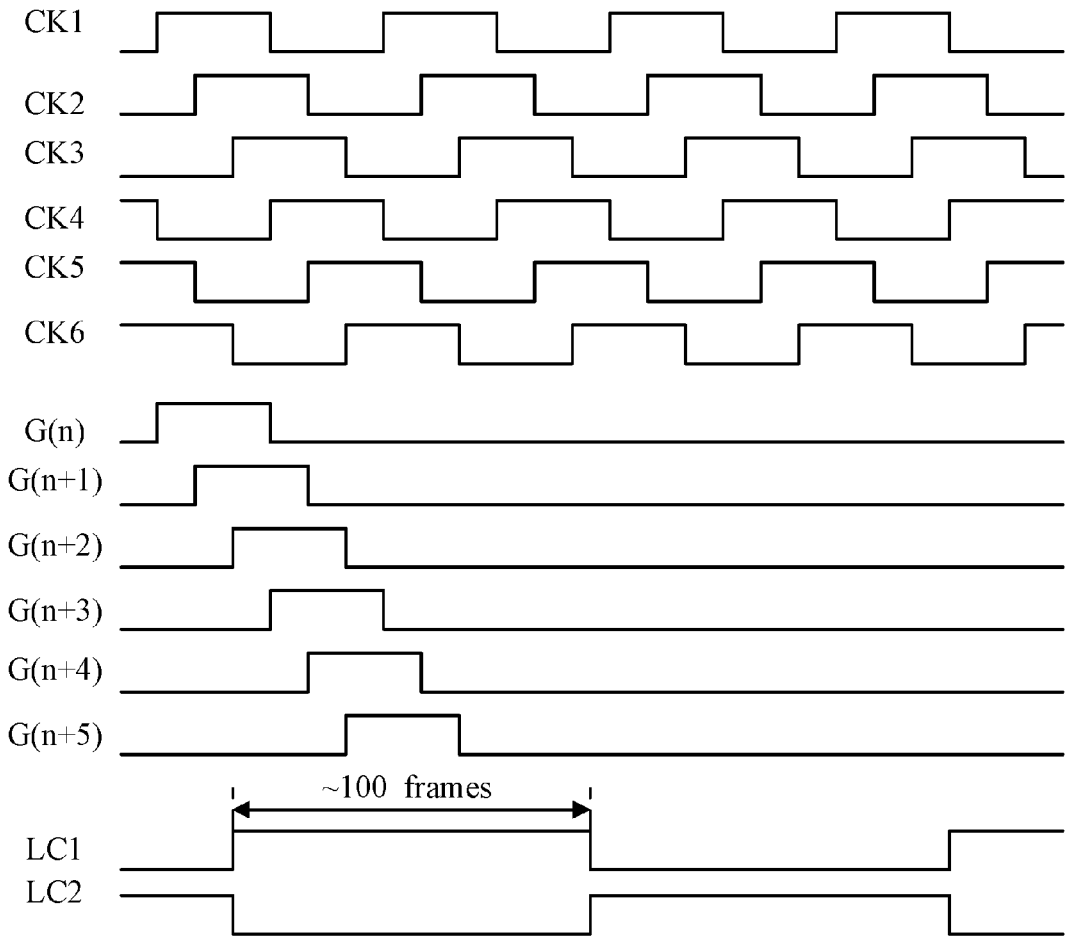
Fig. 3 (Prior art)
FIG. 3 shows waveforms of signals applied the GOA circuit as shown in FIG. 2.

The GOA circuit 35 proposed by this embodiment can output signals from three gate lines, so it is good for increasing the height of layout, narrowing down the width, and designing narrow bezels. In addition, the GOA circuit 35 at each stage comprises twenty-one transistors. On contrast, the conventional GOA circuit 25 as shown in FIG. 2 comprises fifty-one TFTs since three gate lines needs the GOA circuit 25 at three stages. Therefore, the GOA circuit 35 needs much smaller space than the conventional GOA circuit 25 does.

Figure 5:
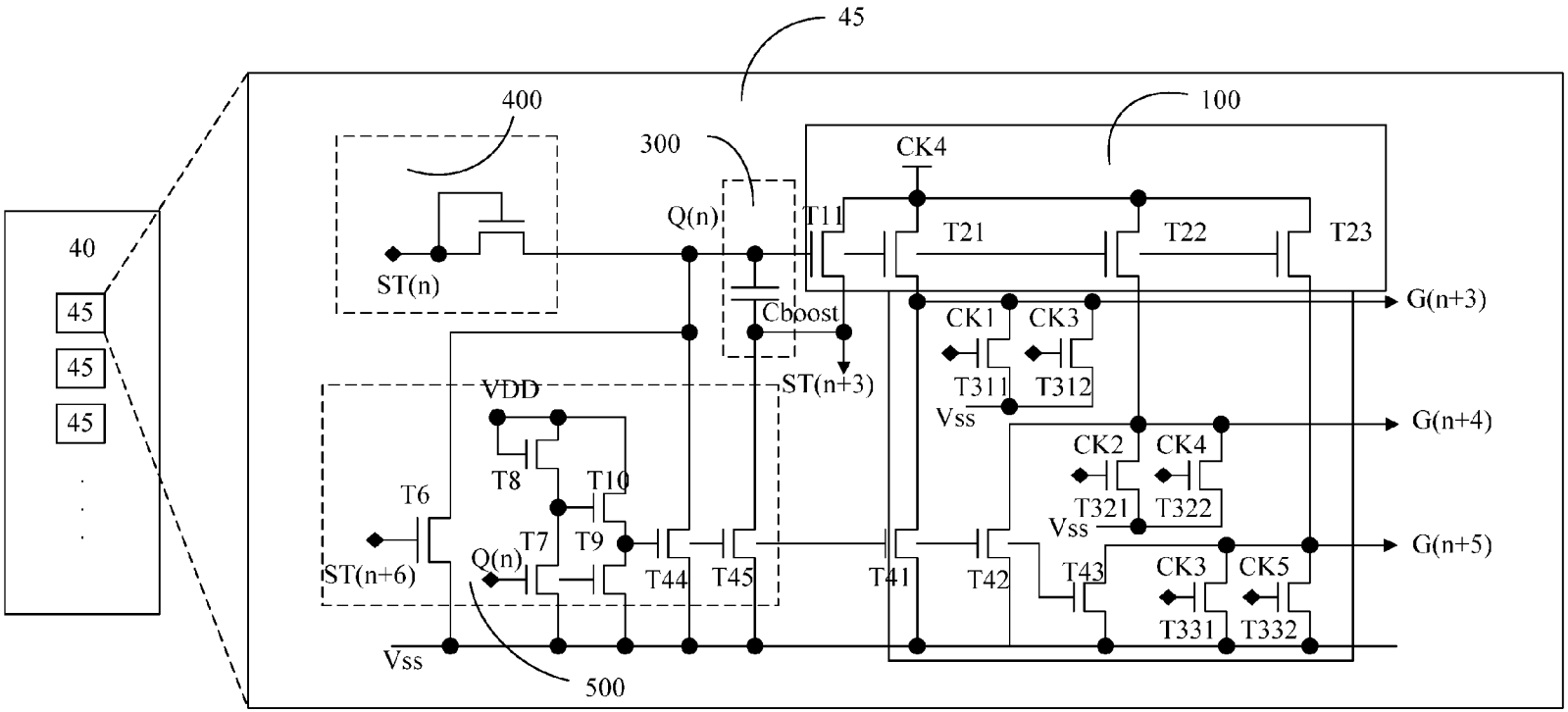
FIG. 5 is a circuit diagram of a GOA circuit according to a second preferred embodiment of the present invention.

FIG. 5 is a circuit diagram of a GOA circuit 40 according to a second preferred embodiment of the present invention. A clear distinction between the second preferred embodiment and the first preferred embodiment is the use of different signals for connections. The details are as follows:

A start pulse ST advances three stages, that is, changing n−3 for n, changing n for n+3, and changing n+3 for n+6.

In the second preferred embodiment, the input terminals of a first transistor T11, a second transistor T21, a third transistor T22, and a fourth transistor T23 are connected to a fourth clock signal CK4. The output terminal of the second transistor T21, the output terminal of the third transistor T22, and the output terminal of the fourth transistor T23 are connected to a scan line G(n+3), a scan line G(n+4), and a scan line G(n+5), respectively.

The control terminal of a fourteenth transistor T311 is connected to a first clock signal CK1. The control terminal of a fifteenth transistor T312 is connected to a third clock signal CK3. The output terminals of the fourteenth transistor T311 and the fifteenth transistor T312 are connected to the scan line G(n+3).

The control terminal of a seventeenth transistor T321 is connected to a second clock signal CK2. The control terminal of an eighteenth transistor T322 is connected to a fourth clock signal CK4. The output terminals of the seventeenth transistor T321 and the eighteenth transistor T322 are connected to the scan line G(n+4).

The control terminal of a twenty T331 is connected to the third clock signal CK3. The control terminal of a twenty-first T332 is connected to a fifth clock signal CK5. The output terminals of the twenty T331 and the twenty-first T332 are connected to the scan line G(n+5).

Compared with the first preferred embodiment where the scan lines at odd stages are driven, the scan lines at even stages are driven in the second preferred embodiment. That's the difference between the two embodiments.

Figure 6:
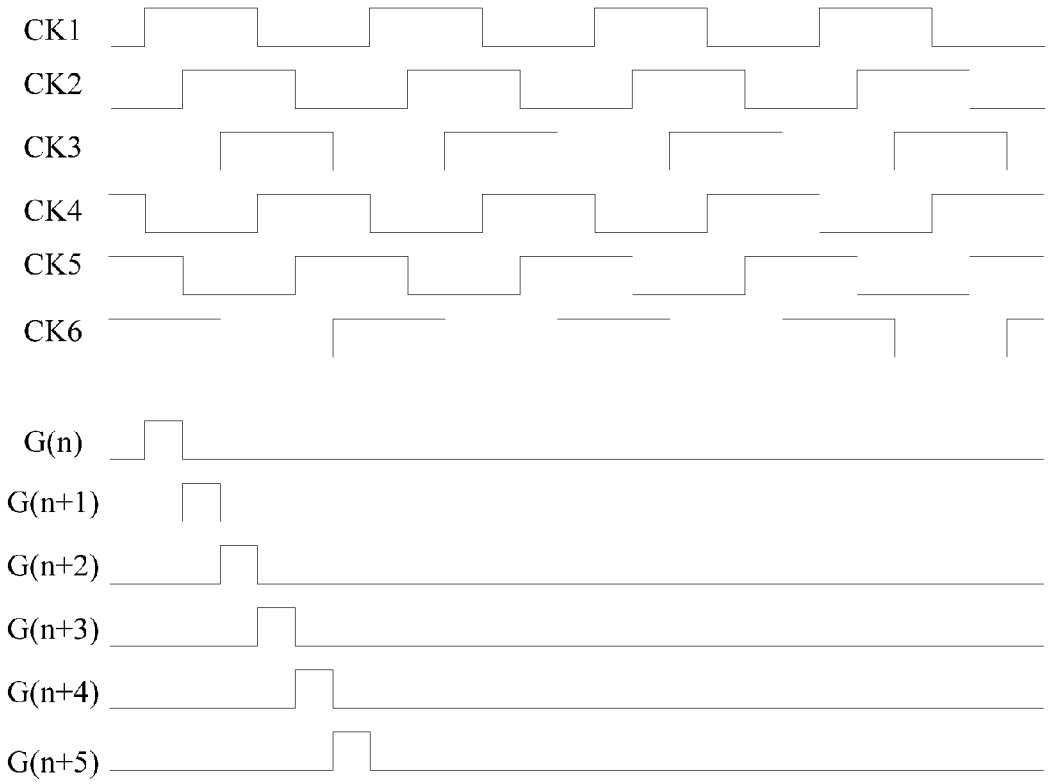
FIG. 6 shows waveforms of signals applied the GOA circuits as shown in FIGS. 4 and 5.

FIG. 6 is a waveform diagram of the GOA circuit shown in FIG. 4 and FIG. 5. The cycle of the first clock signal CK1, the cycle of the second clock signal CK2, and the cycle of the third clock signal CK3 are the same. Also, the first clock signal CK1, the second clock signal CK2, and the third clock signal CK3 are enabled subsequently based on the difference of a ⅓ cycle. The fourth clock signal CK4, the fifth clock signal CK5, and the sixth clock signal CK6 are inverting signals of the first clock signal CK1, the second clock signal CK2, and the third clock signal CK3, respectively. Therefore, signals for enabling the scan lines (from the nth stage to the (n+5)th stage) subsequently are obtained.

Figure 7:
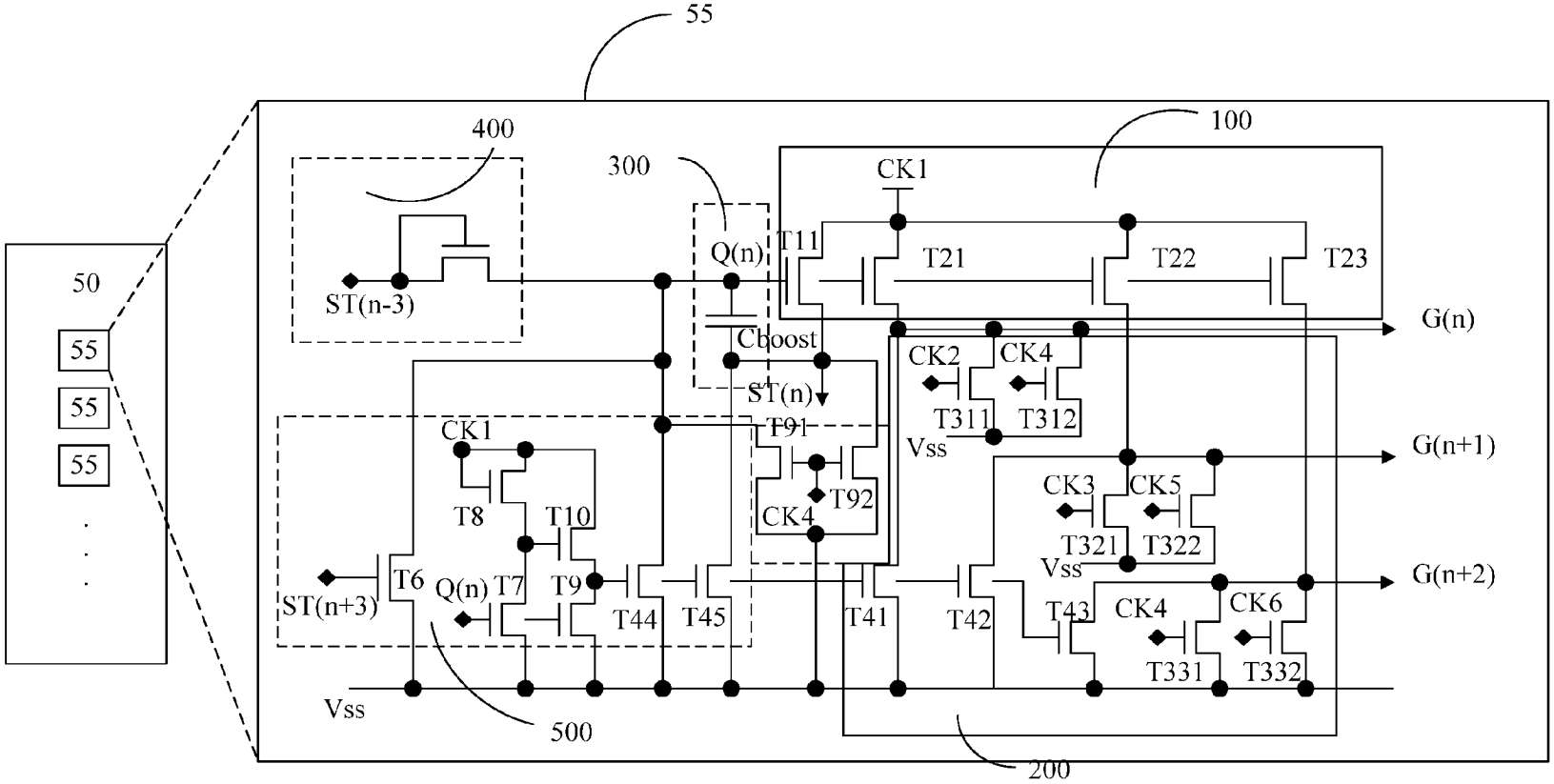
FIG. 7 is a circuit diagram of a GOA circuit according to a third preferred embodiment of the present invention.

FIG. 7 is a circuit diagram of the structure of a GOA circuit 50 according to a third preferred embodiment of the present invention. Compared with the first preferred embodiment, a second pull-down holding circuit comprising a twenty-second transistor T91 and a twenty-three transistor T92 is added in the third preferred embodiment. That's the difference between the two embodiments.

The twenty-second transistor T91 comprises a twenty-second control terminal, a twenty-second input terminal, and a twenty-second output terminal. The twenty-second control terminal is connected to a fourth clock signal CK4. The twenty-second input terminal is connected to a direct current low supply voltage Vss. The twenty-second output terminal is connected to a gate signal node Q(n). The twenty-third transistor T92 comprises a twenty-third control terminal, a twenty-third input terminal, and a twenty-third output terminal. The twenty-third control terminal is connected to the fourth clock signal CK4. The twenty-third input terminal is connected to the direct current low supply voltage Vss. The twenty-third output terminal is connected to a start pulse ST(n) at the nth stage.

The GOA circuit 55 at each stage adopts two pairs of pull-down holding circuit (500,600). The pairs of pull-down holding circuit (500,600) are pulled down at different time slots. In this way, the transistors in the pairs of pull-down holding circuit (500,600) do not need to bear long-time stress. Electrical drift, which may results in ineffectiveness of the GOA circuit 55, does not occur, either. Accordingly, the stability of the LCD panel is greatly improved.

When the GOA circuit 55 performs outputting, i.e., the gate signal node Q(n) at high voltage level, the two pairs of pull-down holding circuit (500,600) do not work, ensuring that correct waveforms are output through the corresponding gate lines. When the GOA circuit 55 does not output, i.e., the gate signal node Q(n) at low voltage level, the two pairs of pull-down holding circuit (500,600) pull down alternatively. When the first clock signal CK1 is at high voltage level and the fourth clock signal CK4 is at low voltage level, the first clock signal CK1 is connected to the nth scan line G(n), the scan line G(n+1), and the scan line G(n+2) through the second transistor T21, the third transistor T22, and the fourth transistor T23, respectively. The nth scan line G(n), the scan line G(n+1), and the scan line G(n+2) are pulled down to enhance the stability of the GOA circuit. In the meantime, the gate signal node Q(n) and the start pulse ST need to be pulled down as well. Such an operation mode is identical to the operation mode of the GOA circuit in the first preferred embodiment. When the first clock signal CK1 is at low voltage level and the fourth clock signal CK4 is at high voltage level, the twenty-second transistor T91 and the twenty-third transistor T92 are forced to be turned on. The gate signal node Q(n) and the start pulse ST are be pulled down. Meanwhile, the first clock signal CK1 is at low voltage level so the corresponding nth scan line G(n), the corresponding scan line at the (n+1)th stage G(n+1), and the corresponding scan line at the (n+2)th stage G(n+2) are also at low voltage level even though the second transistor T21, the third transistor T22, and the fourth transistor T23 leak electricity. There is no influence on the output of the nth scan line G(n), the scan line G(n+1), and the scan line G(n+2). So the nth scan line G(n), the scan line G(n+1), and the scan line G(n+2) do not need to be pulled down.

Figure 8:
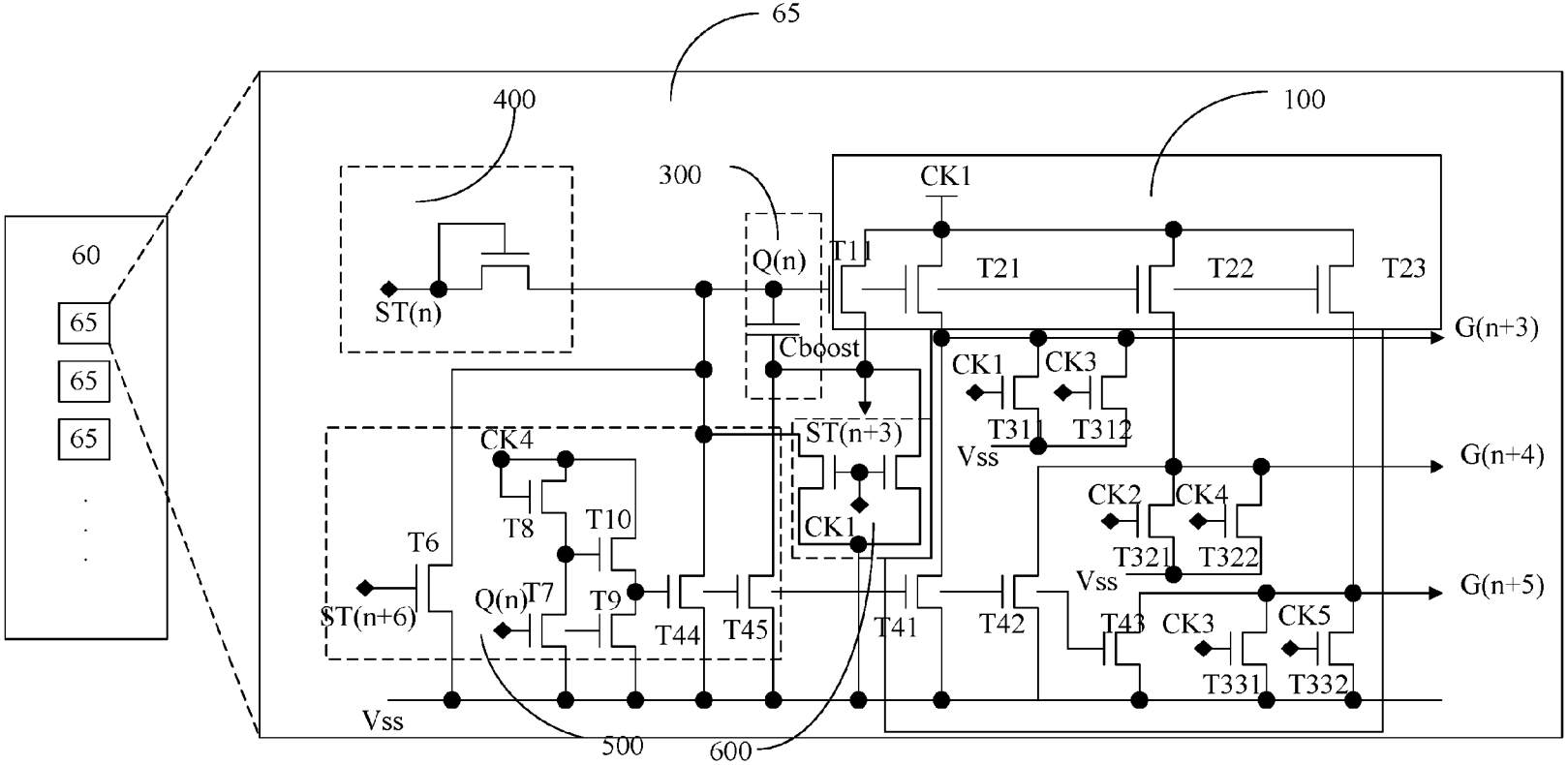
FIG. 8 is a circuit diagram of a GOA circuit according to a fourth preferred embodiment of the present invention.

FIG. 8 is a circuit diagram of the structure of a GOA circuit 60 according to a fourth preferred embodiment of the present invention. A clear distinction between the fourth preferred embodiment and the third preferred embodiment is the use of different signals for connections. The details are as follows:

A start pulse ST advances three stages, that is, changing n−3 for n, changing n for n+3, and changing n+3 for n+6.

In the fourth preferred embodiment, the input terminals of a first transistor T11, a second transistor T21, a third transistor T22, and a fourth transistor T23 are connected to a fourth clock signal CK4. The output terminal of the second transistor T21, the output terminal of the third transistor T22, and the output terminal of the fourth transistor T23 are connected to a scan line G(n+3), a scan line G(n+4), and a scan line G(n+5), respectively.

The control terminal of a fourteenth transistor T311 is connected to a first clock signal CK1. The control terminal of a fifteenth transistor T312 is connected to a third clock signal CK3. The output terminals of the fourteenth transistor T311 and the fifteenth transistor T312 are connected to the scan line G(n+3).

The control terminal of a seventeenth transistor T321 is connected to a second clock signal CK2. The control terminal of an eighteenth transistor T322 is connected to a fourth clock signal CK4. The output terminals of the seventeenth transistor T321 and the eighteenth transistor T322 are connected to the scan line G(n+4).

The control terminal of a twenty T331 is connected to the third clock signal CK3. The control terminal of a twenty-first T332 is connected to a fifth clock signal CK5. The output terminals of the twenty T331 and the twenty-first T332 are connected to the scan line G(n+5).

The control terminals of a twenty-second transistor T91 and a twenty-three transistor T92 are connected to the first clock signal CK1.

Compared with the third preferred embodiment where the scan lines at odd stages are driven, the scan lines at even stages are driven in the fourth preferred embodiment. That's the difference between the two embodiments.

While the present invention has been described in connection with what is considered the most practical and preferred embodiments, it is understood that this invention is not limited to the disclosed embodiments but is intended to cover various arrangements made without departing from the scope of the broadest interpretation of the appended claims.

What is claimed is:

1. A gate driver on array (GOA) circuit for a liquid crystal display (LCD), comprising: a plurality of GOA units connected in cascade, each of the plurality of GOA units corresponding to a stage the GOA unit at an nth stage corresponds to at least one scan line, the at least one scan line comprising a nth scan line, a (n+1)th scan line, and a (n+2)th scan line, the GOA unit at the an nth stage comprising:

a first pull-down holding circuit, connected to a gate signal node;

a pull-up circuit, connected to the first pull-down holding circuit through the gate signal node;

a bootstrap capacitance circuit, connected to the pull-up circuit through the gate signal node;

a pull-down circuit, connected to the bootstrap capacitance circuit through the gate signal node and the first pull-down holding circuit; and a clock circuit, connected to the bootstrap capacitance circuit through the gate signal node and receiving a first clock signal;

wherein the first pull-down holding circuit and the pull-down circuit are connected to a direct current low supply voltage;

the clock circuit comprises:

a first transistor, comprising a first control terminal connected to the gate signal node, a first input terminal connected to the first clock signal, and a first output terminal outputting a start pulse at an nth stage;

a second transistor, comprising a second control terminal connected to the gate signal node, a second input terminal connected to the first clock signal, and a second output terminal connected to the nth scan line;

a third transistor, comprising a third control terminal connected to the gate signal node, a third input terminal connected to the first clock signal, and a third output terminal connected to the (n+1)th scan line; and a fourth transistor, comprising a fourth control terminal connected to the gate signal node, a fourth input terminal connected to the first clock signal, and a fourth output terminal connected to the (n+2)th scan line;

wherein the pull-down circuit comprises:

a thirteenth transistor, comprising a thirteenth control terminal connected to the first pull-down holding circuit, a thirteenth input terminal connected to the direct current low supply voltage, and a thirteenth output terminal connected to the nth scan line;

a fourteenth transistor, comprising a fourteenth control terminal connected to a second clock, a fourteenth input terminal connected to the direct current low supply voltage, and a fourteenth output terminal connected to the nth scan line;

a fifteenth transistor, comprising a fifteenth control terminal connected to a fourth clock signal, a fifteenth input terminal connected to the direct current low supply voltage, and a fifteenth output terminal connected to the nth scan line;

a sixteenth transistor, comprising a sixteenth control terminal connected to the first pull-down holding circuit, a sixteenth input terminal connected to the direct current low supply voltage, and a sixteenth output terminal connected to the (n+1)th scan line;

a seventeenth transistor, comprising a seventeenth control terminal connected to a third clock signal, a seventeenth input terminal connected to the direct current low supply voltage, and a seventeenth output terminal connected to the (n+1)th scan line;

an eighteenth transistor, comprising an eighteenth control terminal connected to a fifth clock signal, an eighteenth input terminal connected to the direct current low supply voltage, and an eighteenth output terminal connected to the (n+1)th scan line;

a nineteenth transistor, comprising a nineteenth control terminal connected to the first pull-down holding circuit, a nineteenth input terminal connected to the direct current low supply voltage, and a nineteenth output terminal connected to the (n+2)th scan line;

a twentieth transistor, comprising a twentieth control terminal connected to the fourth clock signal, a twentieth input terminal connected to the direct current low supply voltage, and a twentieth output terminal connected to the (n+2)th scan line;

a twentieth-first transistor, comprising a twenty-first control terminal connected to a sixth clock signal, a twenty-first input terminal connected to the direct current low supply voltage, and a twenty-first output terminal connected to the (n+2)th scan line; and wherein the cycle of the first clock signal, the cycle of the second clock signal, and the cycle of the third clock signal are the same, and the first clock signal, the second clock signal, and the third clock signal are triggered subsequently based on the difference of a ⅓ cycle; the fourth clock signal is inversed to the first clock signal, the fifth clock signal is inversed to the second clock signal, and the sixth clock signal is inversed to the third clock signal.

2. A gate driver on array (GOA) circuit for a liquid crystal display (LCD), comprising: a plurality of GOA units connected in cascade, each of the plurality of GOA units corresponding to a stage, at stages formed the GOA unit at an nth stage corresponds to at least one scan line, the at least one scan line comprising a nth scan line, a (n+1)th scan line, and a (n+2)th scan line, the GOA unit at the an nth stage comprising:

a first pull-down holding circuit, connected to a gate signal node;

a pull-up circuit, connected to the first pull-down holding circuit through the gate signal node;

a bootstrap capacitance circuit, connected to the pull-up circuit through the gate signal node;

a pull-down circuit, connected to the bootstrap capacitance circuit through the gate signal node; and the first pull-down holding circuit; and a clock circuit, connected to the bootstrap capacitance circuit through the gate signal node and receiving a first clock signal;

wherein the first pull-down holding circuit and the pull-down circuit are connected to a direct current low supply voltage;

the clock circuit comprises:

a first transistor, comprising a first control terminal connected to the gate signal node, a first input terminal connected to the first clock signal, and a first output terminal outputting a start pulse at an nth stage;

a second transistor, comprising a second control terminal connected to the gate signal node, a second input terminal connected to the first clock signal, and a second output terminal connected to the nth scan line;

a third transistor, comprising a third control terminal connected to the gate signal node, a third input terminal connected to the first clock signal, and a third output terminal connected to the (n+1)th scan line; and a fourth transistor, comprising a fourth control terminal connected to the gate signal node, a fourth input terminal connected to the first clock signal, and a fourth output terminal connected to the (n+2)th scan line.

3. The GOA circuit of claim 2, wherein the bootstrap capacitance circuit comprises:

a first capacitor, comprising a first terminal connected to the gate signal node and a second terminal connected to the start pulse at the nth stage.

4. The GOA circuit of claim 2, wherein the pull-up circuit comprises:

a fifth transistor, comprising a fifth control terminal receiving a start pulse at an (n−3)th stage, a fifth input terminal connected to the fifth control terminal, and a fifth output terminal connected to the gate signal node.

5. The GOA circuit of claim 2, wherein the first pull-down holding circuit comprises:

a sixth transistor, comprising a sixth control terminal receiving a start pulse at the (n+3)th stage, a sixth input terminal connected to the direct current low supply voltage, and a sixth output terminal connected to the gate signal node;

a seventh transistor, comprising a seventh control terminal connected to the gate signal node, and a seventh input terminal connected to the direct current low supply voltage;

an eighth transistor, comprising an eighth control terminal connected to a direct current high supply voltage, an eighth output terminal connected to the eighth control terminal, and an eighth input terminal connected to a seventh output terminal;

a ninth transistor, comprising a ninth control terminal connected to the gate signal node, and a ninth input terminal connected to the direct current low supply voltage;

a tenth transistor, comprising a tenth control terminal connected to the seventh output terminal, a tenth input terminal connected to the ninth output terminal, and a tenth output terminal connected to the eighth output terminal;

an eleventh transistor, comprising an eleventh control terminal connected to the tenth input terminal, an eleventh input terminal connected to the direct current low supply voltage, and an eleventh output terminal connected to the gate signal node;

a twelfth transistor, comprising a twelfth control terminal connected to the tenth input terminal, a twelfth input terminal connected to the direct current low supply voltage, and a twelfth output terminal connected to the start pulse at the nth stage.

6. The GOA circuit of claim 2, wherein the pull-down circuit comprises:

a thirteenth transistor, comprising a thirteenth control terminal connected to the first pull-down holding circuit, a thirteenth input terminal connected to the direct current low supply voltage, and a thirteenth output terminal connected to the nth scan line;

a fourteenth transistor, comprising a fourteenth control terminal connected to a second clock, a fourteenth input terminal connected to the direct current low supply voltage, and a fourteenth output terminal connected to the nth scan line;

a fifteenth transistor, comprising a fifteenth control terminal connected to a fourth clock signal, a fifteenth input terminal connected to the direct current low supply voltage, and a fifteenth output terminal connected to the nth scan line;

a sixteenth transistor, comprising a sixteenth control terminal connected to the first pull-down holding circuit, a sixteenth input terminal connected to the direct current low supply voltage, and a sixteenth output terminal connected to the (n+1)th scan line;

a seventeenth transistor, comprising a seventeenth control terminal connected to a third clock signal, a seventeenth input terminal connected to the direct current low supply voltage, and a seventeenth output terminal connected to the (n+1)th scan line;

an eighteenth transistor, comprising an eighteenth control terminal connected to a fifth clock signal, an eighteenth input terminal connected to the direct current low supply voltage, and an eighteenth output terminal connected to the (n+1)th scan line;

a nineteenth transistor, comprising a nineteenth control terminal connected to the first pull-down holding circuit, a nineteenth input terminal connected to the direct current low supply voltage, and a nineteenth output terminal connected to the (n+2)th scan line;

a twentieth transistor, comprising a twentieth control terminal connected to the fourth clock signal, a twentieth input terminal connected to the direct current low supply voltage, and a twentieth output terminal connected to the (n+2)th scan line;

a twentieth-first transistor, comprising a twenty-first control terminal connected to a sixth clock signal, a twenty-first input terminal connected to the direct current low supply voltage, and a twenty-first output terminal connected to the (n+2)th scan line.

7. The GOA circuit of claim 6, wherein the cycle of the first clock signal, the cycle of the second clock signal, and the cycle of the third clock signal are the same, and the first clock signal, the second clock signal, and the third clock signal are triggered subsequently based on the difference of a ⅓ cycle.

8. The GOA circuit of claim 6, wherein the fourth clock signal is inversed to the first clock signal, the fifth clock signal is inversed to the second clock signal, and the sixth clock signal is inversed to the third clock signal.

9. The GOA circuit of claim 2, wherein the GOA circuit further comprises a second pull-down holding circuit, comprising:

a twentieth-second transistor, comprising a twenty-second control terminal connected to the fourth clock signal, a twenty-second input terminal connected to a direct current low supply voltage, and a twenty-second output terminal connected to the gate signal node;

a twentieth-third transistor, comprising a twenty-third control terminal connected to the fourth clock signal, a twenty-third input terminal connected to the direct current low supply voltage, and a twenty-third output terminal connected to the start pulse at the nth stage.

10. A gate driver on array (GOA) circuit for a liquid crystal display (LCD), comprising: a plurality of GOA units connected in cascade, each of the plurality of GOA units corresponding to a stage, at stages formed, the GOA unit at an nth stage corresponds to at least one scan line, the at least one scan line comprising a (n+3)th scan line, a (n+4)th scan line, and a (n+5)th scan line, the GOA unit at the an nth stage comprising:

a first pull-down holding circuit, connected to a gate signal node;

a pull-up circuit, connected to the first pull-down holding circuit through the gate signal node;

a bootstrap capacitance circuit, connected to the pull-up circuit through the gate signal node;

a pull-down circuit, connected to the bootstrap capacitance circuit through the gate signal node and the first pull-down holding circuit; and a clock circuit, connected to the bootstrap capacitance circuit through the gate signal node and receiving a fourth clock signal;

wherein the first pull-down holding circuit and the pull-down circuit are connected to a direct current low supply voltage;

the clock circuit comprises:

a first transistor, comprising a first control terminal connected to the gate signal node, a first input terminal connected to the fourth clock signal, and a first output terminal outputting a start pulse at an (n+3)th stage;

a second transistor, comprising a second control terminal connected to the gate signal node, a second input terminal connected to the fourth clock signal, and a second output terminal connected to the (n+4)th scan line;

a third transistor, comprising a third control terminal connected to the gate signal node, a third input terminal connected to the fourth clock signal, and a third output terminal connected to the (n+5)th scan line; and a fourth transistor, comprising a fourth control terminal connected to the gate signal node, a fourth input terminal connected to the fourth clock signal, and a fourth output terminal connected to the (n+5)th scan line.

11. The GOA circuit of claim 10, wherein the bootstrap capacitance circuit comprises:

a first capacitor comprising a first terminal connected to the gate signal node and a second terminal connected to the start pulse at the (n+3)th stage.

12. The GOA circuit of claim 10, wherein the pull-up circuit comprises:

a fifth transistor, comprising a fifth control terminal receiving a start pulse at an nth stage, a fifth input terminal connected to the fifth control terminal, and a fifth output terminal connected to the gate signal node.

13. The GOA circuit of claim 10, wherein the first pull-down holding circuit comprises:

a sixth transistor, comprising a sixth control terminal receiving a start pulse at the (n+6)th stage, a sixth input terminal connected to the direct current low supply voltage, and a sixth output terminal connected to the gate signal node;

a seventh transistor, comprising a seventh control terminal connected to the gate signal node, and a seventh input terminal connected to the direct current low supply voltage;

an eighth transistor, comprising an eighth control terminal connected to a direct current high supply voltage, an eighth output terminal connected to the eighth control terminal, and an eighth input terminal connected to a seventh output terminal;

a ninth transistor, comprising a ninth control terminal connected to the gate signal node, and a ninth input terminal connected to the direct current low supply voltage;

a tenth transistor, comprising a tenth control terminal connected to the seventh output terminal, a tenth input terminal connected to the ninth output terminal, and a tenth output terminal connected to the eighth output terminal;

an eleventh transistor, comprising an eleventh control terminal connected to the tenth input terminal, an eleventh input terminal connected to the direct current low supply voltage, and an eleventh output terminal connected to the gate signal node;

a twelfth transistor, comprising a twelfth control terminal connected to the tenth input terminal, a twelfth input terminal connected to the direct current low supply voltage, and a twelfth output terminal connected to the start pulse at the (n+3)th stage.

14. The GOA circuit of claim 10, wherein the pull-down circuit comprises:

a thirteenth transistor, comprising a thirteenth control terminal connected to the first pull-down holding circuit, a thirteenth input terminal connected to the direct current low supply voltage, and a thirteenth output terminal connected to the (n+3)th scan line;

a fourteenth transistor, comprising a fourteenth control terminal connected to a first clock, a fourteenth input terminal connected to the direct current low supply voltage, and a fourteenth output terminal connected to the (n+3)th scan line;

a fifteenth transistor, comprising a fifteenth control terminal connected to a third clock signal, a fifteenth input terminal connected to the direct current low supply voltage, and a fifteenth output terminal connected to the (n+3)th scan line;

a sixteenth transistor, comprising a sixteenth control terminal connected to the first pull-down holding circuit, a sixteenth input terminal connected to the direct current low supply voltage, and a sixteenth output terminal connected to the (n+4)th scan line;

a seventeenth transistor, comprising a seventeenth control terminal connected to a second clock signal, a seventeenth input terminal connected to the direct current low supply voltage, and a seventeenth output terminal connected to the (n+4)th scan line;

an eighteenth transistor, comprising an eighteenth control terminal connected to a fourth clock signal, an eighteenth input terminal connected to the direct current low supply voltage, and an eighteenth output terminal connected to the (n+4)th scan line;

a nineteenth transistor, comprising a nineteenth control terminal connected to the first pull-down holding circuit, a nineteenth input terminal connected to the direct current low supply voltage, and a nineteenth output terminal connected to the (n+5)th scan line;

a twentieth transistor, comprising a twentieth control terminal connected to the third clock signal, a twentieth input terminal connected to the direct current low supply voltage, and a twentieth output terminal connected to the (n+5)th scan line;

a twentieth-first transistor, comprising a twenty-first control terminal connected to a fifth clock signal, a twenty-first input terminal connected to the direct current low supply voltage, and a twenty-first output terminal connected to the (n+5)th scan line.

15. The GOA circuit of claim 14, wherein the cycle of the first clock signal, the cycle of the second clock signal, and the cycle of the third clock signal are the same, and the first clock signal, the second clock signal, and the third clock signal are triggered subsequently based on the difference of a ⅓ cycle.

16. The GOA circuit of claim 14, wherein the fourth clock signal is inversed to the first clock signal, the fifth clock signal is inversed to the second clock signal, and the sixth clock signal is inversed to the third clock signal.

17. The GOA circuit of claim 10, wherein the GOA circuit further comprises a second pull-down holding circuit, comprising:

a twentieth-second transistor, comprising a twenty-second control terminal connected to the first clock signal, a twenty-second input terminal connected to a direct current low supply voltage, and a twenty-second output terminal connected to the gate signal node;

a twentieth-third transistor, comprising a twenty-third control terminal connected to the first clock signal, a twenty-third input terminal connected to the direct current low supply voltage, and a twenty-third output terminal connected to the start pulse at the (n+3)th stage.

* * * * *